US006786812B2

(12) United States Patent
Stuckenholz et al.

(10) Patent No.: US 6,786,812 B2
(45) Date of Patent: Sep. 7, 2004

(54) SUPPORTING DISK FOR A SURFACE GRINDING WHEEL AND SURFACE GRINDING WHEEL

(75) Inventors: Bernd Stuckenholz, Wiehl (DE); Bernd Trompelt, Crimmitschau (DE); Bernd Preissler, Oschatz (DE); Gisela Gross, Oschatz (DE)

(73) Assignees: August Rüggeberg GmbH & Co., Marienheide (DE); P-D Glasseiden GmbH Oschatz, Oschatz (DE)

( * ) Notice: Subject to any disclaimer, the term of this patent is extended or adjusted under 35 U.S.C. 154(b) by 91 days.

(21) Appl. No.: 10/072,972

(22) Filed: Feb. 12, 2002

(65) Prior Publication Data

US 2002/0187737 A1 Dec. 12, 2002

(30) Foreign Application Priority Data

Feb. 12, 2001 (DE) ..... 101 06 631

(51) Int. Cl.[7] ..... B24D 13/04

(52) U.S. Cl. ..... 451/490; 451/463; 451/526; 451/532; 451/536

(58) Field of Search ..... 451/463, 465, 451/466, 490, 537, 553, 540, 544, 526, 532, 536, 548; 51/297

(56) References Cited

U.S. PATENT DOCUMENTS

| | | | | | |
|---|---|---|---|---|---|
| RE24,548 | E | * | 10/1958 | Erickson | 51/206 |
| 3,685,215 | A | * | 8/1972 | Bates | 451/546 |
| 3,828,485 | A | * | 8/1974 | McClure | 451/546 |
| 3,838,543 | A | * | 10/1974 | Lakhani | 451/546 |
| 4,062,153 | A | * | 12/1977 | Malm | 451/544 |
| 5,431,596 | A | * | 7/1995 | Akita et al. | 451/540 |
| 5,752,876 | A | | 5/1998 | Hettes | |
| 5,924,917 | A | * | 7/1999 | Benedict et al. | 451/526 |
| 5,951,389 | A | * | 9/1999 | Hettes et al. | 451/508 |

FOREIGN PATENT DOCUMENTS

| | | |
|---|---|---|
| DE | 77 10 651 U1 | 7/1977 |
| DE | 295 10 727 | 8/1995 |
| DE | 298 05 508 U1 | 7/1998 |
| DE | 299 10 931 U1 | 9/1999 |
| DE | 299 14 325 U1 | 1/2000 |
| DE | 200 06 127 | 8/2000 |
| DE | 200 05 548 U1 | 9/2000 |
| WO | WO 00 78506 | 12/2000 |

* cited by examiner

*Primary Examiner*—Joseph J. Hail, III
*Assistant Examiner*—Anthony Ojini
(74) *Attorney, Agent, or Firm*—Browdy and Neimark, P.L.L.C.

(57) ABSTRACT

A supporting disk for a surface grinding wheel comprises a glass-fiber reinforced phenolic resin body which has an upper covering layer of a textile glass fabric or a glass-yarn layer, an intermediate layer of a fiber mat, and a lower covering layer of a textile glass fabric or a glass-yarn layer.

12 Claims, 2 Drawing Sheets

SUPPORTING DISK FOR A SURFACE GRINDING WHEEL AND SURFACE GRINDING WHEEL

BACKGROUND OF THE INVENTION

1. Field of the Invention

The invention relates to supporting disks for a surface grinding wheel and to a surface grinding wheel comprising a supporting disk.

2. Background Art

Surface grinding wheels comprise a supporting disk and abrasive laminas mounted thereon. The abrasive laminas, which deliver stock removal upon operation, customarily comprise commercial abrasives on a cotton or polyester substrate. As a rule, the abrasive laminas are being fixed on the supporting disk by epoxide resin adhesive. The supporting disk serves for rotating the abrasive laminas and for the pressure necessary for the grinding job to be transmitted by the operator from the driving motor to the abrasive laminas and, consequently, to the subject that is to be machined. Consequently, the supporting disk is only of indirect importance for the result of the grinding job. Another important function of the supporting disk resides in ensuring the necessary safeguard against centrifugal fracture of the surface grinding wheel. Surface grinding wheels are regularly operated at a circumferential speed ranging from 50 m/s to 80 m/s. The considerable mechanical stresses that occur in the supporting disk in this case demand for the use of high-strength material.

It is known from DE 200 05 548 U1 and DE 299 14 325 U1 to make the supporting disk of metal.

DE 298 05 508 U1 further teaches to manufacture a supporting disk for a surface grinding wheel from metal and to provide the outer edge thereof with a plastic material protective arrangement.

It is known from DE 299 10 931 U1 to manufacture a supporting disk for a surface grinding wheel from synthetic resin which is at least partially reinforced by natural fibers.

It is further known to embody supporting disks as glass-fiber reinforced phenolic resin bodies. The production costs are very high in particular when a supporting disk of this type includes a plurality of textile-glass fabrics. More than five and even more than twelve layers of textile-glass fabrics are used as a safeguard against centrifugal fracture.

In particular the flexural strength of the supporting disks is of decisive importance as a safeguard of the tools against centrifugal fracture. When loaded by centrifugal forces, the supporting disk sags as a result of the weight of the abrasive laminas that bears on it, which strongly loads the adhesive mechanically, terminating in the laminas being torn off.

In order to obtain the required flexural strength of the supporting disk, a sufficiently great number of glass fabrics must be selected, which is the present level of knowledge. The necessary number of fabric layers depends on the total weight of the abrasive laminas that are mounted on the supporting disk. The number of abrasive laminas is also directly proportional to the lifetime of the tool. Therefore, tools that have a long lifetime must com-comprise a plurality of fabric layers, for example twelve layers, so as to comply with safety requirements.

SUMMARY OF THE INVENTION

It is an object of the invention to embody a supporting disk for a surface grinding wheel in such a way that the supporting disk can be manufactured at a low cost while keeping its highly protective properties of safeguard against centrifugal fracture and to embody a surface grinding wheel that comprises a supporting disk of this type.

This object is attained in a supporting disk for a surface grinding wheel, consisting of a glass-fiber reinforced phenolic resin body, which includes an upper covering layer of a textile glass fabric; an intermediate layer of a fiber fleece; and a lower covering layer of a textile glass fabric. According to the invention, a comparatively expensive textile glass fabric is utilized only in the upper and lower covering layer, whereas a simple intermediate layer in the form of a fiber fleece is used as a filler between these two covering layers. When the supporting disk is loaded during grinding operation, mechanical stresses occur in addition to the strain due to centrifugal force as a result of the supporting disk sagging in the direction of its axis. The greatest bending stresses occur upon loading of the surface areas, while the intermediate area remains almost stress-free when loaded by bending. The coverings of textile glass fabric have a higher loading capacity than the fiber-mat intermediate layer. As opposed to the prior art number of five layers or more, the supporting disk according to the invention only comprises three layers, of which only the two exterior coverings consist of comparatively costly fabrics or layers while the intermediate layer consists of a comparatively low-cost fiber fleece as a filler. The job of the intermediate layer primarily resides in producing as great a distance as possible between the two coverings that possess by far greater tensile strength than the intermediate layer. As a rule, the intermediate layer is thicker than the covering layers.

Generally, the design of the surface grinding disk that is manufactured using a supporting disk of this type is conventional.

Further advantages, features and details of the invention will become apparent from the ensuing description of exemplary embodiments, taken in conjunction with the drawing.

DESCRIPTION OF THE PREFERRED EMBODIMENTS

Figure 1:
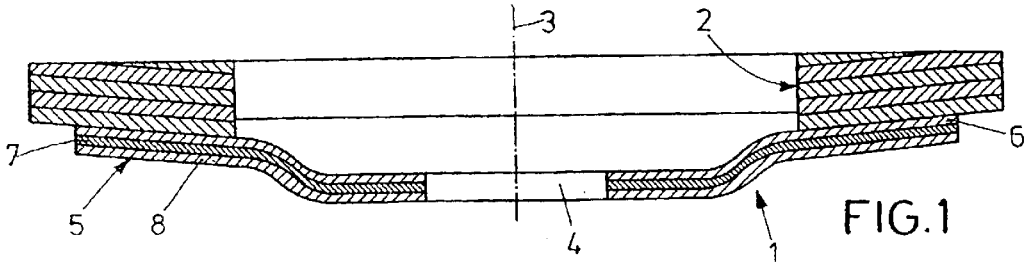
FIG. 1 is a central cross-sectional view of a surface grinding wheel.

As seen in FIG. 1, the fundamental and familiar design of a surface grinding wheel includes a supporting disk 1 and abrasive laminas 2. The supporting disk 1 has the shape of a circular ring with a central longitudinal axis 3. Concentrically of the axis 3, it is provided with an opening 4 for accommodation of the driving shaft of a driving motor. The supporting disk 1 further comprises an outer annular marginal area 5, to which the abrasive laminas 2 are customarily fixed by means of glue (not shown), overlapping each other. As further seen in FIG. 1, the supporting disk again comprises an upper covering layer 6, an intermediate layer 7 and a lower covering layer 8.

Figure 2:
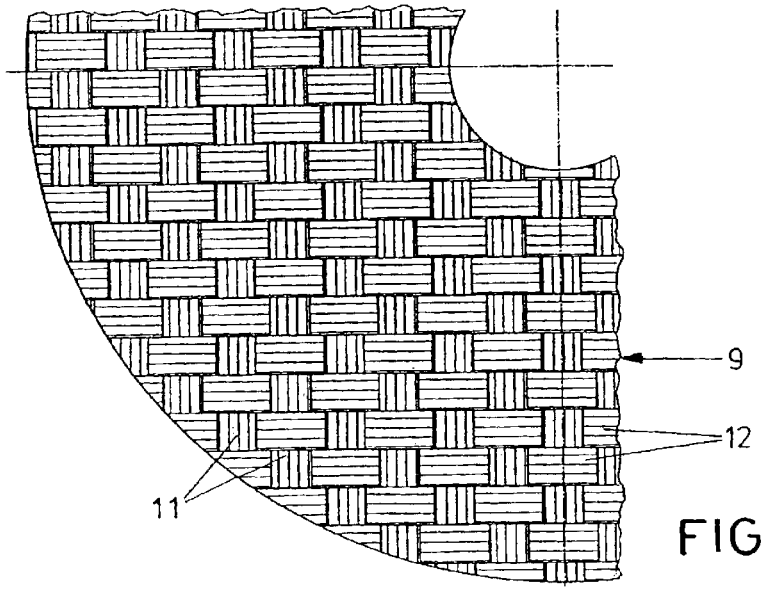
FIG. 2 is a plan view of a textile glass fabric.

The upper covering layer 6 and the lower covering layer 8 consist of a textile glass fabric 9 as seen in FIG. 2. The textile glass fabric 9 consists of parallel warp threads 11 and equally parallel weft threads 12 which are perpendicular to the warp threads 11. As illustrated in FIG. 2, in the case of the textile glass fabric 9, the weft threads 12 are led alternately above and below the neighboring warp threads 11 for the linen weave illustrated. Of course, it is conceivable to make use of a weave other than the linen weave. Fundamentally, the fabrics 9 include two systems of warp threads 11 and weft threads 12 that cross at right angles for a given type of weave.

The warp threads 11 and the weft threads 12 may be glass fibers pre-processed into yarns or twines. For cost reasons, they will however be rovings serving the purpose. Fundamentally, rovings constitute a plurality of textile glass filaments that are combined nearly in parallel, having among them a given, largely identical strand fineness.

The intermediate layer 7 consists of a fiber fleece. Natural fibers, for example hemp or sisal, may be used as a fiber material as well as synthetic organic fibers such as polyester or polypropylene or textile glass fibers.

Figure 3:
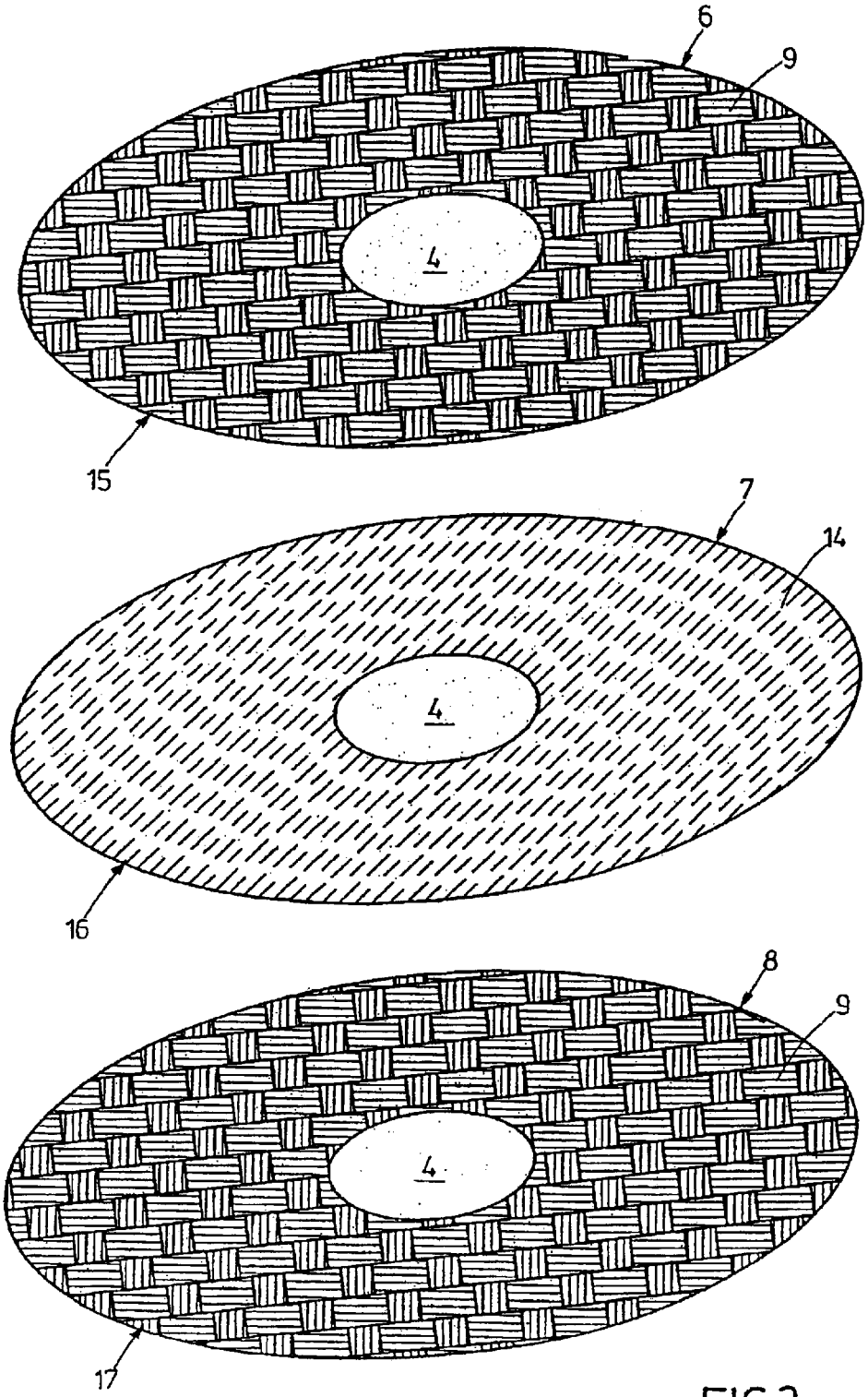
FIG. 3 is an explosive view of a blank for a supporting disk with covering layers of textile glass fabric.

FIG. 3 is an explosive view of a blank 15 for the upper covering layer 6, a blank 16 for the intermediate layer 7 and a blank 17 for the lower covering layer 8. All the blanks 15 to 17 already have the opening 4, but they are still plane. A textile glass fabric 9 is used for the upper covering layer 6 and the lower covering layer 8.

Producing a supporting disk 1 takes place as follows:

The textile glass fabrics 9 and the fiber fleece are produced and combined in such a way that a textile glass fabric 9 as an upper covering layer 6 and as a lower covering layer 8 accommodate the intermediate layer 7 between them. The three combined layers 6 to 8 may be sewn together by threads as a safeguard during transport. This compound of layers or the individual layers are impregnated by phenolic resin, from which the blanks are subsequently punched.

This package of the upper covering layer 6, intermediate layer 7 and lower covering layer 8 is pressed and cured under the action of pressure and heat for the glass-fiber reinforced phenolic resin supporting disk 1 to form, which is then customarily worked into a surface grinding wheel.

What is claimed is:

1. A supporting disk for a surface grinding wheel with laminas, the supporting disk consisting of a glass-fiber reinforced phenolic resin body, which includes an upper covering layer (6) of a textile glass fabric (9);

an intermediate layer (7) of a fiber fleece; and a lower covering layer (8) of a textile glass fabric (9) and wherein the upper covering layer (6) and the lower covering layer (8) have a higher tensile strength than the intermediate layer (7).

2. A supporting disk according to claim 1, wherein the intermediate layer (7) is comprised of natural fibers.

3. A supporting disk according to claim 1, wherein the intermediate layer (7) is comprised of synthetic organic fibers.

4. A supporting disk according to claim 1, wherein the upper covering layer (6), the intermediate layer (7) and the lower covering layer (8) are sewn together.

5. A supporting disk according to claim 1, wherein the textile glass fabric (9) and the glass-yarn layer (10) are comprised of warp threads (11) and weft threads (12) which are glass-fiber rovings.

6. A supporting disk according to claim 1, wherein the intermediate layer (7) is thicker than the upper covering layer (6) and the lower covering layer (8).

7. A surface grinding wheel comprising a supporting disk (1) and abrasive laminas (2) fixed to the supporting disk (1), the supporting disk (1) consisting of a glass-fiber reinforced phenolic resin body, which includes an upper covering layer (6) of a textile glass fabric (9);

an intermediate layer (7) of a fiber fleece; and a lower covering layer (8) of a textile glass fabric (9) and wherein the upper covering layer (6) and the lower covering layer (8) have a higher tensile strength than the intermediate layer (7).

8. A surface grinding wheel according to claim 7, wherein the intermediate layer (7) is comprised of natural fibers.

9. A surface grinding wheel according to claim 7, wherein the intermediate layer (7) is comprised of synthetic organic fibers.

10. A surface grinding wheel according to claim 7, wherein the upper covering layer (6), the intermediate layer (7) and the lower covering layer (8) are sewn together.

11. A surface grinding wheel according to claim 7, wherein the textile glass fabric (9) and the glass-yarn layer (10) are comprised of warp threads (11) and weft threads (12) which are glass-fiber rovings.

12. A surface grinding wheel according to claim 7, wherein the intermediate layer (7) is thicker than the upper covering layer (6) and the lower covering layer (8).

* * * * *